US009741306B2

(12) United States Patent
Kim et al.

(10) Patent No.: US 9,741,306 B2
(45) Date of Patent: Aug. 22, 2017

(54) DISPLAY DEVICE

(71) Applicant: Samsung Display Co., Ltd., Yongin, Gyeonggi-Do (KR)

(72) Inventors: Ji-Sun Kim, Seoul (KR); Jonghee Kim, Yongin-si (KR); Youngwan Seo, Suwon-si (KR); Jaekeun Lim, Suwon-si (KR); Chongchul Chai, Seoul (KR)

(73) Assignee: Samsung Display Co., Ltd. (KR)

( * ) Notice: Subject to any disclaimer, the term of this patent is extended or adjusted under 35 U.S.C. 154(b) by 79 days.

(21) Appl. No.: 14/835,573

(22) Filed: Aug. 25, 2015

(65) Prior Publication Data

US 2016/0171924 A1 Jun. 16, 2016

(30) Foreign Application Priority Data

Dec. 15, 2014 (KR) ..... 10-2014-0180592

(51) Int. Cl.
*G09G 3/36* (2006.01)

(52) U.S. Cl.
CPC ... *G09G 3/3648* (2013.01); *G09G 2310/0297* (2013.01); *G09G 2310/08* (2013.01); *G09G 2320/0219* (2013.01)

(58) Field of Classification Search
CPC ..... G09G 2310/0297; G09G 2310/08; G09G 2320/0219; G09G 3/3648
See application file for complete search history.

(56) References Cited

U.S. PATENT DOCUMENTS

| | | | | |
|---|---|---|---|---|
| 8,780,761 | B2 | 7/2014 | Mathoulis et al. | |
| 2006/0071884 | A1* | 4/2006 | Kim | G09G 3/3233 345/76 |
| 2012/0026134 | A1 | 2/2012 | Ehrilich et al. | |
| 2012/0056558 | A1 | 3/2012 | Toshiya et al. | |
| 2014/0160096 | A1 | 6/2014 | Li et al. | |

FOREIGN PATENT DOCUMENTS

| | | |
|---|---|---|
| KR | 10-2007-0001476 | 1/2007 |
| KR | 10-2007-0121865 | 12/2007 |
| KR | 10-2011-0030955 | 3/2011 |
| KR | 10-1082283 | 11/2011 |
| KR | 10-2012-0087146 | 8/2012 |
| KR | 10-2014-0072593 | 6/2014 |

* cited by examiner

*Primary Examiner* — Latanya Bibbins
(74) *Attorney, Agent, or Firm* — Innovation Counsel LLP

(57) ABSTRACT

According to an embodiment, a display device includes a display panel including a plurality of pixels respectively connected to a plurality of gate lines and a plurality of data lines, a gate driver driving the plurality of gate lines, a data driver configured to output a plurality of data output signals to the plurality of data lines in response to a data signal, a demultiplexer circuit configured to provide the plurality of data output signals to the plurality of data lines in response to a first selection signal and a second selection signal; and a timing controller configured to provide the data signal to the data driver, outputting the first selection signal and the second selection signal, and controlling the gate driver.

13 Claims, 8 Drawing Sheets

DISPLAY DEVICE

CROSS-REFERENCE TO RELATED APPLICATIONS

This U.S. non-provisional patent application claims priority under 35 U.S.C. §119 of Korean Patent Application No. 10-2014-0180592, filed on Dec. 15, 2014, the contents of which are hereby incorporated by reference in its entirety.

BACKGROUND

The present disclosure herein relates to a display device.

In general, a display device includes a display panel for displaying an image, and a data driver and a gate driver for driving the display panel. The display panel includes a plurality of gate lines, a plurality of data lines, and a plurality of pixels. Each of the plurality of pixels includes a switching transistor, a liquid crystal capacitor, and a storage capacitor. The data driver outputs a data driving signal to data lines and the gate driver outputs a gate driving signal for driving the gate lines.

By applying a gate-on voltage to a predetermined gate line by the gate driver, a data voltage corresponding to an image signal is provided to the data lines through the data driver to display an image.

Recently, as the size of a display panel is increased, the number of data lines becomes greater. Since the number of data lines that a data driver integrated circuit (IC) with a limited size can drive is limited, more data driver ICs are required for driving the display panel having a greater number of data lines.

SUMMARY

The present disclosure provides a display device for reducing the number of required data driver integrated circuits (ICs).

The present disclosure provides a display device for preventing the deterioration of an image quality even when the number of data driver ICs is reduced.

Embodiments of the inventive concept provide display devices including: a display panel including a plurality of pixels respectively connected to a plurality of gate lines and a plurality of data lines; a gate driver configured to drive the plurality of gate lines; a data driver configured to output a plurality of data output signals to the plurality of data lines in response to a data signal; a demultiplexer circuit configured to provide the plurality of data output signals to the plurality of data lines in response to a first selection signal and a second selection signal; and a timing controller configured to provide the data signal to the data driver, outputting the first selection signal and the second selection signal, and controlling the gate driver, wherein the demultiplexer circuit may include a plurality of demultiplexers each of which is connected to at least two data lines, the demultiplexer of the plurality of demultiplexers includes: a first transistor connected between the data output signal and a first data line among the at least two data lines and including a gate terminal connected to the first selection signal; and a first capacitor connected between the second selection signal and the first data line.

In some embodiments, the first capacitor may have the same capacitance as a parasitic capacitance between the first selection signal and the first data line.

In other embodiments, the timing controller sequentially may activate the first and second selection signals.

In still other embodiments, the demultiplexer may provide the data output signal to the first data line when the first selection signal is activated and may provide the data output signal to the second data line when the second selection signal is activated.

In even other embodiments, the demultiplexer may further include: a second transistor connected between the data output signal and a second data line among the at least two data lines and including a gate terminal connected to the second selection signal; and a second capacitor connected between the first selection signal and the second data line.

In yet other embodiments, the second capacitor may have the same capacitance as a parasite capacitor between the second selection signal and the second data line.

The first selection signal may be an inversion signal of the second selection signal.

In further embodiments, the demultiplexer may further include a signal path configured to transfer the data output signal to the second data line and may provide the data output signal to the first and second data lines when the first selection signal is activated.

In still further embodiments, a maximum signal level and a minimum signal level of each of the first and second selection signals may be identical to each other.

Embodiments of the inventive concept provide display devices including: a display panel including a plurality of pixels respectively connected to a plurality of gate lines and a plurality of data lines; a gate driver configured to drive the plurality of gate lines; a data driver configured to output a plurality of data output signals to the plurality of data lines in response to a data signal; a demultiplexer circuit configured to provide the plurality of data output signals to the plurality of data lines in response to a first selection signal and a dummy selection signal; and a timing controller configured to provide the data signal to the data driver, outputting the first selection signal and the dummy selection signal, and controlling the gate driver, wherein the demultiplexer circuit includes a plurality of demultiplexers each of which is connected to at least two data lines, the demultiplexer of the plurality of demultiplexers may include: a first transistor connected between the data output signal and a first data line among the at least two data lines and including a gate terminal connected to the first selection signal; and a first capacitor connected between the dummy selection signal and a second data line In some embodiments, the first capacitor may have the same capacitance as a parasitic capacitance between the first selection signal and the first data line.

In some embodiments, the demultiplexer may provide the data output signal to the first data line and the second data line when the first selection signal is activated and provides the data output signal to the second data line when the first selection signal is deactivated.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE EMBODIMENTS

It is understood that when an element or layer is referred to as being "on", "connected to" or "coupled to" another element or layer, it may be directly on, connected or coupled to the other element or layer, or intervening elements or layers may be present between the element or layer and the another element or layer. In contrast, when an element is referred to as being "directly on," "directly connected to" or "directly coupled to" another element or layer, there are no intervening elements or layers present. Like numbers refer to like elements throughout the specification. As used herein, the term "and/or" includes any and all combinations of one or more of the associated listed items.

It is understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below may be referred to as a second element, component, region, layer or section without departing from the teachings of the present system and method.

Spatially relative terms, such as "beneath", "below", "lower", "above", "upper" and the like, may be used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" encompasses both an orientation of above and below. If the device is otherwise oriented (rotated 90 degrees or at other orientations), the spatially relative descriptors used herein are to be interpreted accordingly.

The terminologies used herein for the purpose of describing particular embodiments are not intended to limit the present disclosure. As used herein, the singular forms, "a", "an" and "the" are intended to include the plural forms as well, unless the context clearly indicates otherwise. It is further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, the present system and method are explained with reference to the accompanying drawings.

Figure 1:
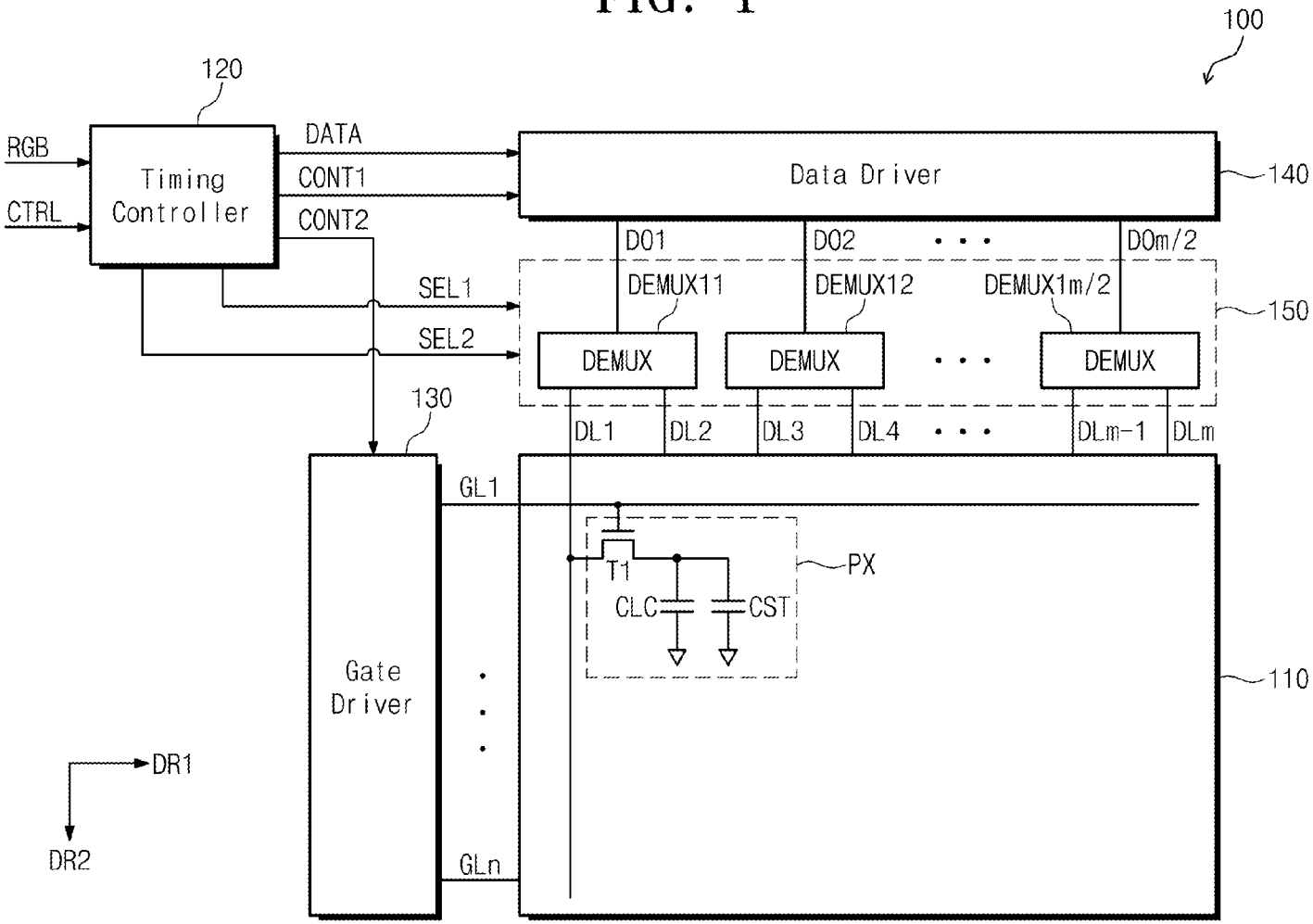
FIG. 1 is a diagram schematically illustrating a configuration of a display device according to an embodiment of the inventive concept.

FIG. 1 is a diagram schematically illustrating a configuration of a display device according to an embodiment of the inventive concept.

Referring to FIG. 1, a display device 100 includes a display panel 110, a timing controller 120, a gate driver 130, a data driver 140, and a demultiplexer (DEMUX) circuit 150.

The display panel 110 includes a plurality of gate lines GL1 to GLn extending in a first direction DR1, a plurality of data lines DL1 to DLm extending in a second direction DR2, and a plurality of pixels PX respectively connected to the plurality of gate lines GL1 to GLn and the plurality of data lines DL1 to DLm. Each of the pixels PX includes a switching transistor T1 connected to a corresponding data line and gate line, and a liquid crystal capacitor CLC and a storage capacitor CST connected thereto.

The timing controller 120 provides a data signal DATA and a first control signal CONT1 to the data driver 140 in response to an image signal RGB and a control signal CTRL provided from the outside and provides a second control signal CONT2 to the gate driver 130. Additionally, the timing controller 120 provides first and second selection signals SEL1 and SEL2 to the demultiplexer circuit 150.

The gate driver 130 sequentially drives the gate lines GL1 to GLn in response to the second control signal CONT2 from the timing controller 120. The data driver 140 outputs data output signals DO1 to DOm/2 for driving the plurality of data lines DL1 to DLm in response to the data signal DATA and the first control signal CONT1 from the timing controller 120. For example, the data output signal DO1 is provided to the data lines DL1 and DL2 through the demultiplexer circuit 150; the data output signal DO2 is provided to the data lines DL3 and DL4 through the demultiplexer circuit 150; and the data output signal DOm/2 is provided to the data lines DLm−1 and DLm through the demultiplexer circuit 150.

The demultiplexer circuit 150 includes a plurality of demultiplexers DEMUX11 to DEMUX1m/2. The plurality of demultiplexers DEMUX11 to DEMUX1m/2 respectively correspond to the data output signals DO1 to DOm/2 outputted from the data driver 140. Each of the demultiplexers DEMUX11 to DEMUX1m/2 sequentially outputs a corresponding data output signal to two data lines. For example, the demultiplexer DEMUX11 sequentially provides the data output signal DO1 to the two data lines DL1 and DL2. The demultiplexer DEMUX12 sequentially provides the data output signal DO2 to the two data lines DL3 and DL4. In the same manner, the demultiplexer DEMUX1m/2 sequentially provides the data output signal DOm/2 to the two data lines DLm−1 and DLm.

The demultiplexer circuit 150 may be disposed on a predetermined area of the display panel 110 or on an additional circuit substrate.

Figure 2:
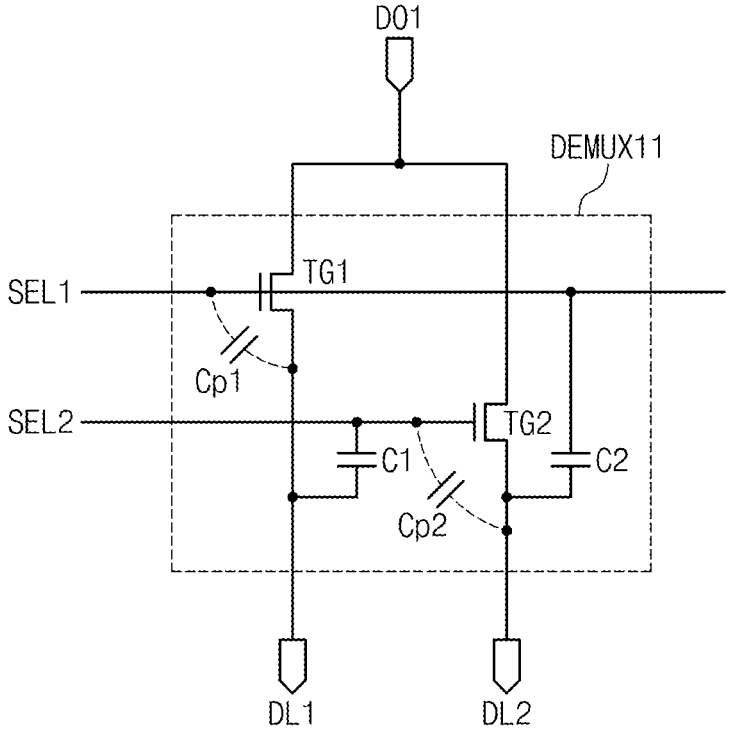
FIG. 2 is a view illustrating a configuration of a demultiplexer in a demultiplexer circuit shown in FIG. 1.

FIG. 2 is a view illustrating a configuration of a demultiplexer in the demultiplexer circuit shown in FIG. 1. Although only the demultiplexer DEMUX11 in the demultiplexer circuit is described with reference to FIG. 2, the other demultiplexers DEMUX12 and DEMUX1m/2 have the same circuit configuration as the demultiplexer DEMUX11 and operate similarly thereto.

Referring to FIG. 2, the demultiplexer DEMUX11 includes a first transistor TG1, a second transistor TG2, a first capacitor C1, and a second capacitor C2.

The first transistor TG1 is connected between the data output signal DO1 and the data line DL1 and includes a gate terminal connected to the first selection signal SELL The second transistor TG2 is connected between the data output signal DO1 and the data line DL2 and includes a gate terminal connected to the second selection signal SEL2. The first capacitor C1 is connected between the second selection signal SEL2 and the data line DL1. The second capacitor C2 is connected between the first selection signal SEL1 and the data line DL2. The demultiplexer DEMUX11 sequentially outputs the data output signal DO1 to the data lines DL1 and DL2 in response to the first and second selection signals SEL1 and SEL2.

Figure 3:
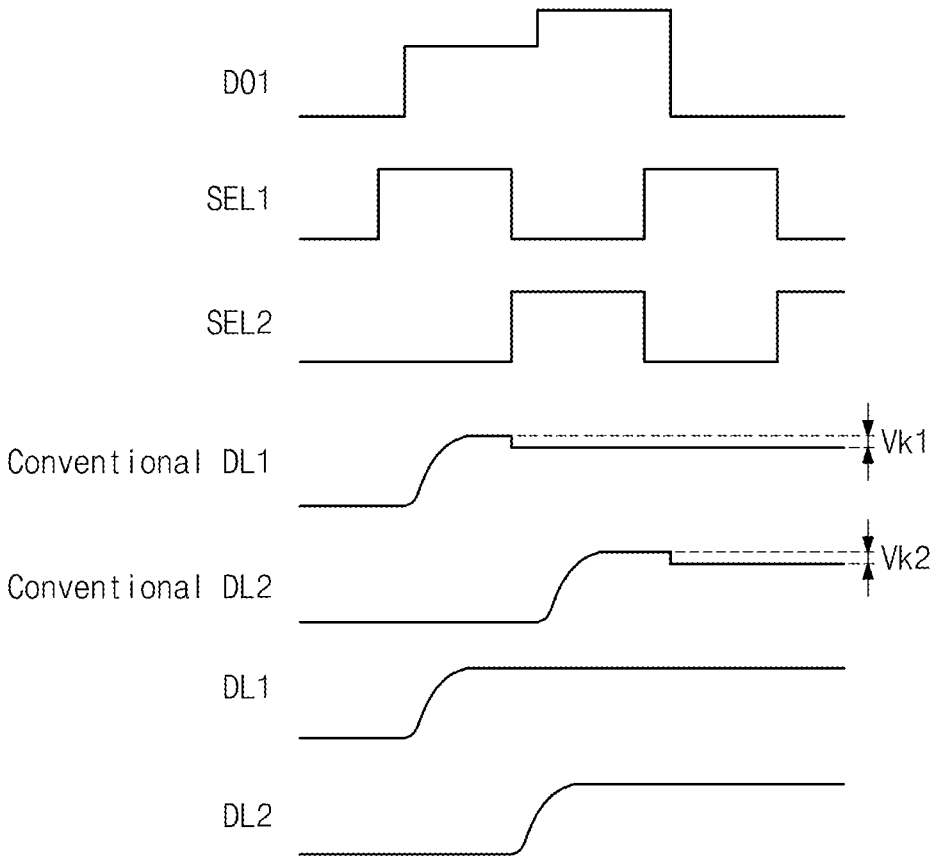
FIG. 3 is a timing diagram illustrating an operation of a demultiplexer shown in FIG. 2.

FIG. 3 is a timing diagram illustrating an operation of the demultiplexer shown in FIG. 2.

Referring to FIGS. 2 and 3, the data output signal DO1 may include a first data signal for the data line DL1 and a second data signal for the data line DL2. While the first selection signal SEL1 is in a high level and the second selection signal SEL2 is in a low level, the first data signal for the data line DL1 among the data output signal DO1 is provided to the data line DL1. While the first selection signal SEL1 is in a low level and the second selection signal SEL2 is in a high level, the second data signal for the data line DL2 among the data output signal DO1 is provided to the data line DL2. In this embodiment, the maximum signal level and the minimum signal level of each of the first and second selection signals SEL1 and SEL2 may be identical to each other.

When the first transistor TG1 is turned on because the first selection signal SEL1 is in a high level, the voltage of the data line DL1 is increased. Even when the first selection signal SEL1 shifts from a high level to a low level, a voltage supplied to the data line DL1 needs to be maintained for a predetermined time in order to allow the liquid crystal capacitor CLC and the storage capacitor CST shown in FIG. 1 to be charged sufficiently.

However, when the first selection signal SEL1 shifts from a high level to a low level, the voltage of the data line DL1 is reduced by a predetermined level by a parasite capacitance Cp1 between a signal line through which the first selection signal SEL1 is transmitted and the data line DL1. This is called a kick-back voltage Vk1. In the same manner, when the second selection signal SEL2 shifts from a high level to a low level, the voltage of the data line DL2 is reduced by a kick-back voltage Vk2 by a parasite capacitance Cp2 between a signal line through which the second selection signal SEL2 is transmitted and the data line DL2.

The first capacitor C1 may be designed to have the same capacitance as the parasite capacitor Cp1 in order to compensate for the kick-back voltage Vk1 by the parasite capacitor Cp1. When the first selection signal SEL1 shifts from a high level to a low level, the second selection signal SEL2 shifts from a low level to a high level. Therefore, the voltage level of the data line DL1 may be maintained to a desired level by the first capacitor C1.

In the same manner, the second capacitor C2 may be designed to have the same capacitance as the parasite capacitor Cp2 in order to compensate for the kick-back voltage Vk2 by the parasite capacitor Cp2. When the second selection signal SEL2 shifts from a high level to a low level, the first selection signal SEL1 shifts from a low level to a high level. Therefore, the voltage level of the data line DL2 may be maintained to a desired level by the second capacitor C2.

Figure 4:
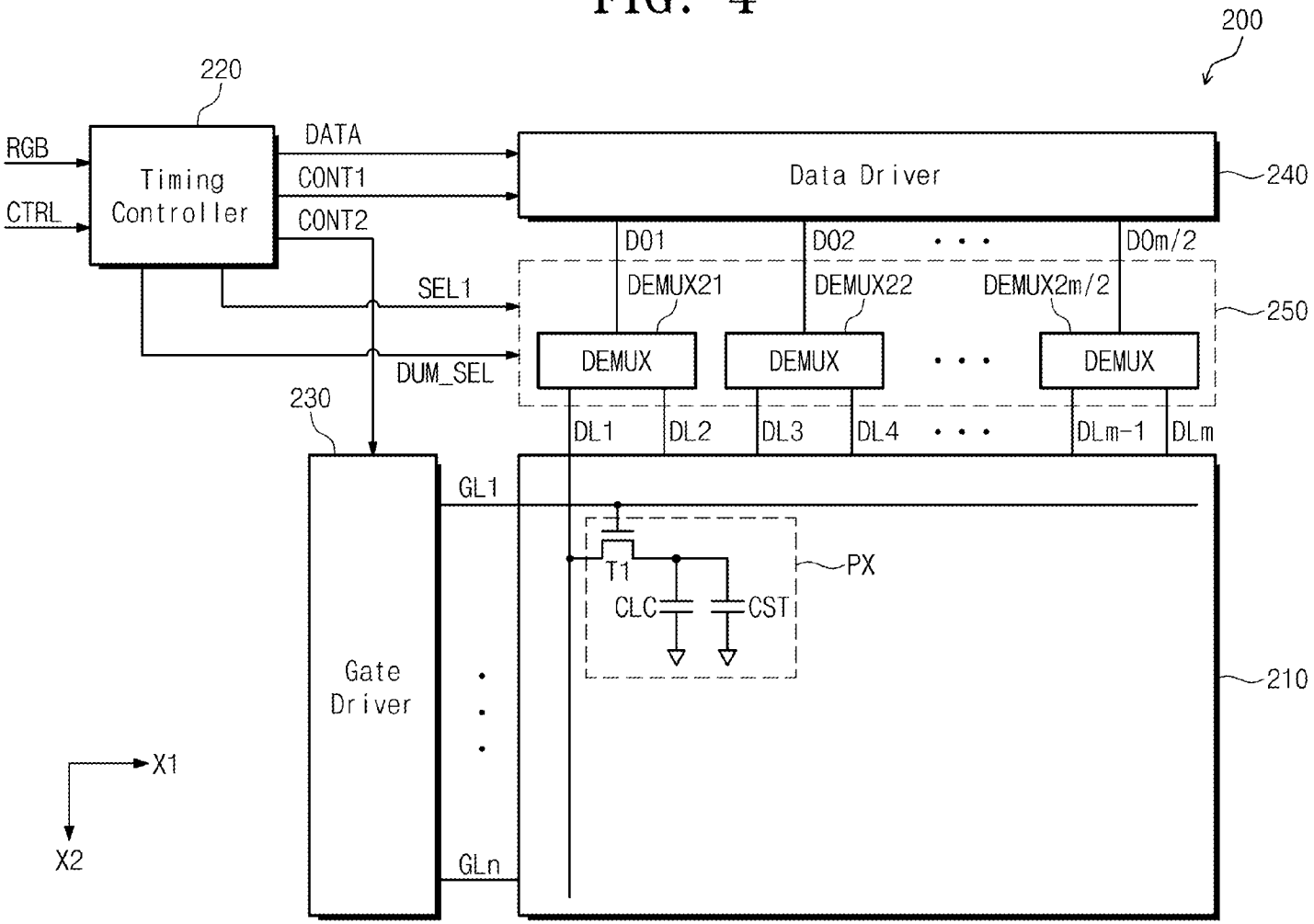
FIG. 4 is a diagram schematically illustrating a configuration of a display device according to another embodiment of the inventive concept.

FIG. 4 is a diagram schematically illustrating a configuration of a display device according to another embodiment of the inventive concept. Since a display device 200 shown in FIG. 4 has a configuration similar or identical to the configuration of the display device 100 shown in FIG. 1, overlapping descriptions are omitted.

Referring to FIG. 4, a display device 200 includes a display panel 210, a timing controller 220, a gate driver 230, a data driver 240, and a demultiplexer circuit 250. The timing controller 220 shown in FIG. 4 provides a first selection signal SEL1 and a dummy selection signal DUM_SEL to the demultiplexer circuit 250.

Figure 5:
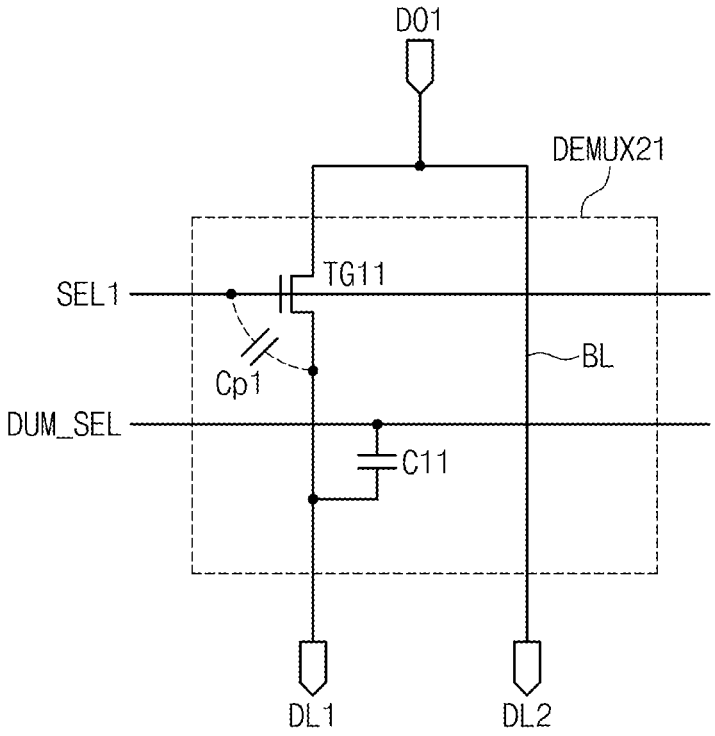
FIG. 5 is a view illustrating a configuration of a demultiplexer in a demultiplexer circuit shown in FIG. 4.

FIG. 5 is a view illustrating a configuration of a demultiplexer in the demultiplexer circuit shown in FIG. 4. Although only the demultiplexer DEMUX21 in the demultiplexer circuit is described with reference to FIG. 5, the other demultiplexers DEMUX22 and DEMUX2m/2 have the same circuit configuration as the demultiplexer DEMUX21 and operate similarly thereto.

Referring to FIG. 5, the demultiplexer DEMUX21 includes a first transistor TG11 and a first capacitor C11.

The first transistor TG11 is connected between a data output signal DO1 and a data line DL1 and includes a gate terminal connected to a first selection signal SELL The first capacitor C11 is connected between a dummy selection signal DUM_SEL and the data line DL1. The demultiplexer DEMUX21 outputs the data output signal DO1 to the data line D1 in response to the first selection signal SELL The demultiplexer DEMUX21 includes a bypass signal line BL connecting the data output signal DO1 and the data line DL2.

Therefore, the data output signal DO1 is transferred to the data line DL2 as it is through the bypass signal line BL.

Figure 6:
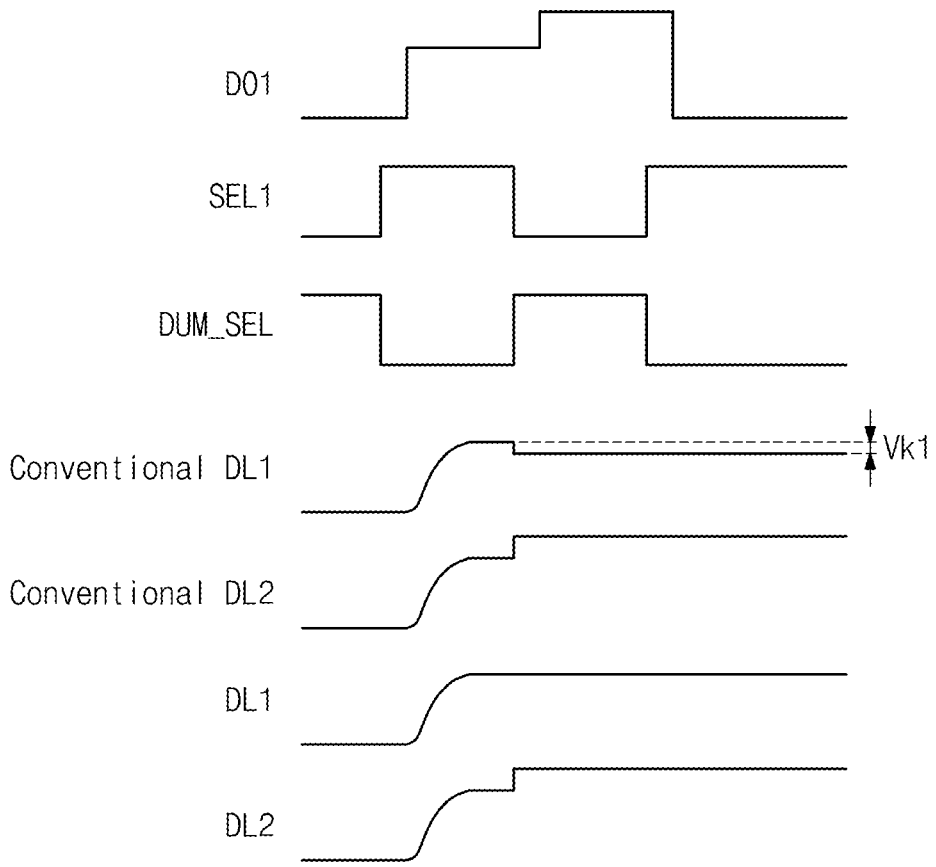
FIG. 6 is a timing diagram illustrating an operation of a demultiplexer shown in FIG. 5.

FIG. 6 is a timing diagram illustrating an operation of the demultiplexer shown in FIG. 5.

Referring to FIGS. 5 and 6, while the first selection signal SEL1 is in a high level, the first data signal for the data line DL1 among the data output signal DO1 is provided to the data lines DL1 and DL2. While the first selection signal SEL1 is in a low level, the second data signal for the data line DL1 among the data output signal DO1 is provided to the data line DL2.

When the first transistor TG1 is turned on because the first selection signal SEL1 is in a high level, the voltage of the data line DL1 is increased. Even when the first selection signal SEL1 shifts from a high level to a low level, a voltage supplied to the data line DL1 needs to be maintained for a predetermined time in order to allow the liquid crystal capacitor CLC and the storage capacitor CST shown in FIG. 1 to be charged sufficiently.

However, when the first selection signal SEL1 shifts from a high level to a low level, the voltage of the data line DL1 is reduced by a predetermined level by a parasite capacitance Cp1 between a signal line through which the first selection signal SEL1 is transmitted and the data line DL1. This is called a kick-back voltage Vk1.

The first capacitor C11 may be designed to have the same capacitance as the parasite capacitor Cp1 in order to compensate for the kick-back voltage Vk1 by the parasite capacitor Cp1. When the first selection signal SEL1 shifts from a high level to a low level, the dummy selection signal DUM_SEL shifts from a low level to a high level. Therefore, the voltage level of the data line DL1 may be increased by the reduced kick-back voltage Vk1 through the first capacitor C11 to maintain a desired level. In this embodiment, the dummy selection signal DUM_SEL is substantially similar to the second selection signal SEL2 shown in FIG. 3.

Figure 7:
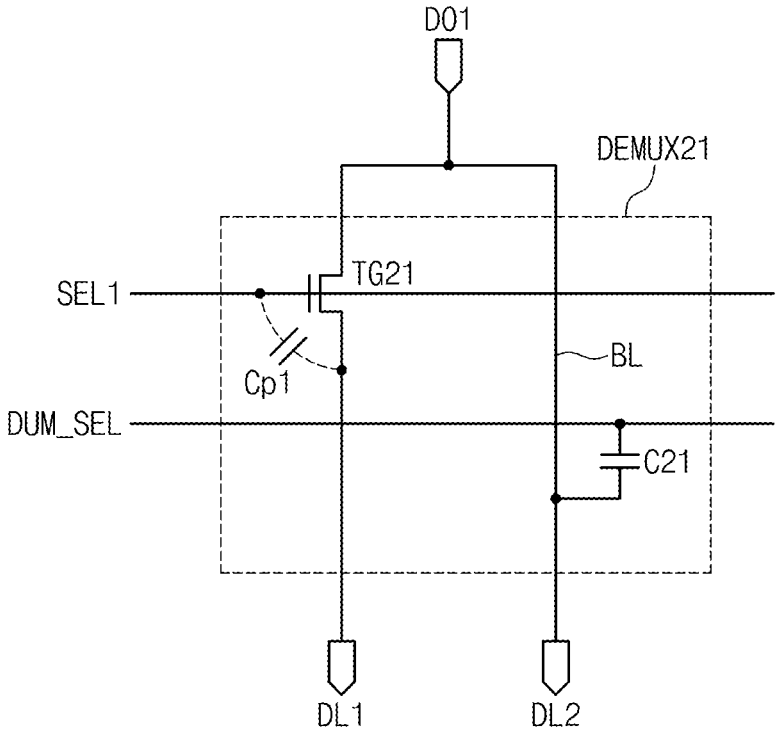
FIG. 7 is a view illustrating a configuration of a demultiplexer in a demultiplexer circuit shown in FIG. 4 according to another embodiment of the inventive concept.

FIG. 7 is a view illustrating a configuration of a demultiplexer in the demultiplexer circuit shown in FIG. 4 according to another embodiment of the inventive concept.

Referring to FIG. 7, the demultiplexer DEMUX21 includes a first transistor TG21 and a first capacitor C21. The first transistor TG21 is connected between the data output signal DO1 and the data line DL1 and includes a gate terminal connected to the first selection signal SELL The first capacitor C21 is connected between a dummy selection signal DUM_SEL and a data line DL2. The demultiplexer DEMUX21 outputs the data output signal DO1 to the data line DL1 in response to the first selection signal SELL The demultiplexer DEMUX21 includes a bypass signal line BL connecting the data output signal DO1 and the data line DL2. Therefore, the data output signal DO1 is transferred to the data line DL2 through the bypass signal line BL.

Figure 8:
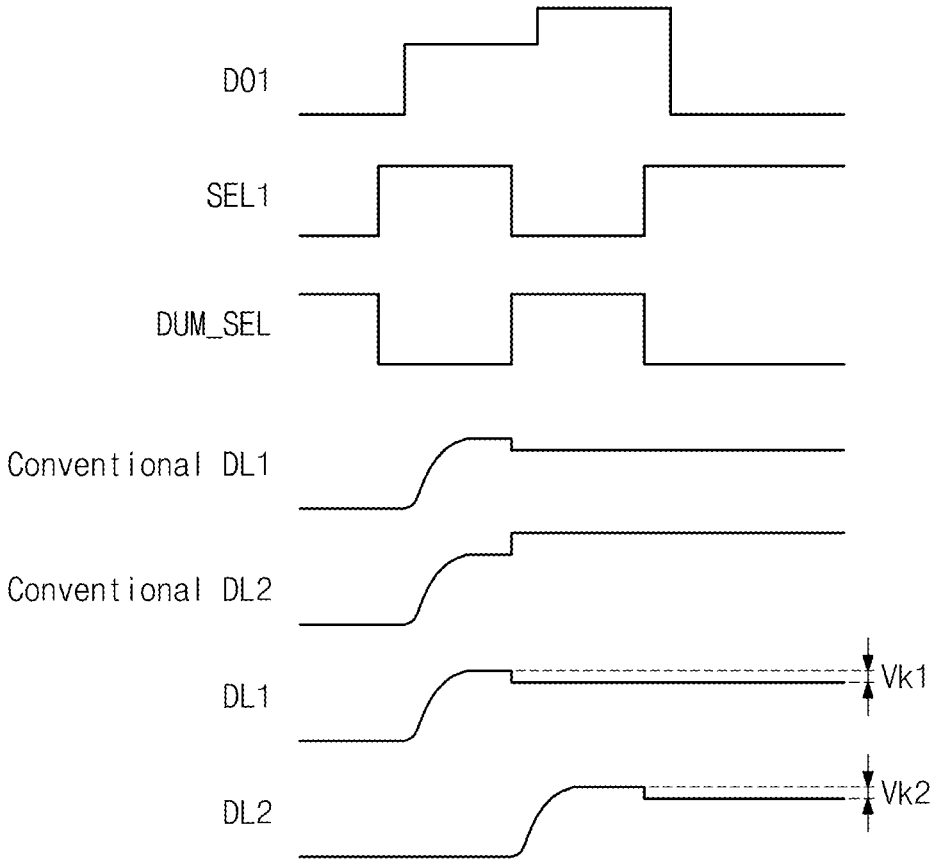
FIG. 8 is a timing diagram illustrating an operation of a demultiplexer shown in FIG. 7.

FIG. 8 is a timing diagram illustrating an operation of the demultiplexer shown in FIG. 7.

Referring to FIGS. 7 and 8, while the first selection signal SEL1 is in a high level, the data output signal DO1 is provided to the data lines DL1 and DL2. While the first selection signal SEL1 is in a low level, the data output signal DO1 is provided to the data line DL2.

When the first transistor TG1 is turned on because the first selection signal SEL1 is in a high level, the voltage of the data line DL1 is increased. Even when the first selection signal SEL1 shifts from a high level to a low level, a voltage supplied to the data line DL1 needs to be maintained for a predetermined time in order to allow the liquid crystal capacitor CLC and the storage capacitor CST shown in FIG. 1 to be charged sufficiently.

However, when the first selection signal SEL1 shifts from a high level to a low level, the voltage of the data line DL1 is reduced by a predetermined level by a parasite capacitance Cp1 between a signal line through which the first selection signal SEL1 is transmitted and the data line DL1. This is called a kick-back voltage Vk1.

The first capacitor C21 may be designed to have the same capacitance as the parasite capacitor Cp1 in order to compensate for the kick-back voltage Vk1 by the parasite capacitor Cp1. When the dummy selection signal DUM_SEL shifts from a high level to a low level, the voltage level of the data line DL2 is reduced by the kick-back voltage Vk1 of the data line DL1 through the first capacitor C21.

Therefore, the kick-back voltage Vk1 of the data line DL1 and the kick-back voltage Vk2 of the data line DL2 become the same (Vk1=Vk2). Therefore, a brightness imbalance phenomenon due to a kick-back voltage difference between the data lines DL1 and DL2 may be eliminated.

A display device having a demultiplexer circuit reduces the number of data driver ICs needed to drive the display device by half Especially, image quality deterioration can be prevented by compensating for a kick-back voltage in the demultiplexer circuit.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display device comprising:

a display panel including a plurality of pixels respectively connected to a plurality of gate lines and a plurality of data lines;

a gate driver configured to drive the plurality of gate lines;

a data driver configured to output a plurality of data output signals to the plurality of data lines in response to a data signal;

a demultiplexer circuit configured to provide the plurality of data output signals to the plurality of data lines in response to a first selection signal and a second selection signal; and a timing controller configured to provide the data signal to the data driver, outputting the first selection signal and the second selection signal, and controlling the gate driver, wherein the demultiplexer circuit comprises a plurality of demultiplexers each of which is connected to at least two data lines, the demultiplexer of the plurality of demultiplexers comprises:

a first transistor connected between the data output signal and a first data line among the at least two data lines and including a gate terminal connected to the first selection signal; and a first capacitor connected between the second selection signal and the first data line, and wherein the first capacitor has the same capacitance as a parasitic capacitance between the first selection signal and the first data line.

2. The display device of claim 1, wherein the timing controller sequentially activates the first selection signal and the second selection signal.

3. The display device of claim 2, wherein the demultiplexer provides the data output signal to the first data line when the first selection signal is activated and provides the data output signal to the second data line when the second selection signal is activated.

4. The display device of claim 2, wherein the demultiplexer further comprises:

a second transistor connected between the data output signal and a second data line among the at least two data lines and including a gate terminal connected to the second selection signal; and a second capacitor connected between the first selection signal and the second data line.

5. The display device of claim 4, wherein the second capacitor has the same capacitance as a parasite capacitor between the second selection signal and the second data line.

6. The display device of claim 5, wherein the first selection signal is an inversion signal of the second selection signal.

7. The display device of claim 2, wherein the demultiplexer further comprises a signal path configured to transfer the data output signal to the second data line and provide the data output signal to the first data line and the second data line when the first selection signal is activated.

8. The display device of claim 7, wherein a maximum signal level and a minimum signal level of each of the first and second selection signals are identical to each other.

9. A display device comprising:

a display panel including a plurality of pixels respectively connected to a plurality of gate lines and a plurality of data lines;

a gate driver configured to drive the plurality of gate lines;

a data driver configured to output a plurality of data output signals to the plurality of data lines in response to a data signal;

a demultiplexer circuit configured to provide the plurality of data output signals to the plurality of data lines in response to a first selection signal and a dummy selection signal; and a timing controller configured to provide the data signal to the data driver, outputting the first selection signal and the dummy selection signal, and controlling the gate driver, wherein the demultiplexer circuit comprises a plurality of demultiplexers each of which is connected to at least two data lines, the demultiplexer of the plurality of demultiplexers comprises:

a first transistor connected between the data output signal and a first data line among the at least two data lines and including a gate terminal connected to the first selection signal; and a first capacitor connected between the dummy selection signal and a second data line among the at least two data lines, and wherein the first capacitor has the same capacitance as a parasitic capacitance between the first selection signal and the first data line.

10. The display device of claim 9, wherein the first selection signal is an inversion signal of the dummy selection signal.

11. The display device of claim 9, wherein the timing controller sequentially activates the first selection signal and the dummy selection signal.

12. The display device of claim 11, wherein the demultiplexer provides the data output signal to the first data line and the second data line when the first selection signal is activated and provides the data output signal to the second data line when the first selection signal is deactivated.

13. The display device of claim 9, wherein the demultiplexer provides the data output signal to the first data line and the second data line when the first selection signal is activated and provides the data output signal to the second data line when the first selection signal is deactivated.

* * * * *